United States Patent [19]

Wesselink et al.

[11] 4,074,172

[45] Feb. 14, 1978

[54] DISCHARGE LAMP OPERATING CIRCUIT

[75] Inventors: Gustaaf Adolf Wesselink; Hendrik Roelofs; Gijsbert Johannes Ponsen, all of Eindhoven, Netherlands

[73] Assignee: U.S. Philips Corporation, New York, N.Y.

[21] Appl. No.: 663,488

[22] Filed: Mar. 3, 1976

[30] Foreign Application Priority Data

Apr. 1, 1975 Netherlands ..... 7503824

[51] Int. Cl.[2] ..... H05B 41/36

[52] U.S. Cl. ..... 315/307; 315/108; 315/109; 315/200 R; 315/362; 315/DIG. 1

[58] Field of Search ..... 315/108, 109, 200 R, 315/358, 362, DIG. 1, 291, 307; 313/174, 181

[56] References Cited

U.S. PATENT DOCUMENTS

| | | | |
|---|---|---|---|
| 1,943,846 | 1/1934 | Spaeth | 315/109 |
| 2,103,039 | 12/1937 | Pirani et al. | 315/108 |
| 3,864,599 | 2/1975 | Wesselink et al. | 315/109 |

*Primary Examiner*—Eugene R. LaRoche
*Attorney, Agent, or Firm*—Frank R. Trifari; Robert S. Smith

[57] ABSTRACT

The invention relates to a device for operating a low-pressure sodium vapor discharge lamp without a stabilizing ballast.

The lamp is provided with a discharge tube having first and second main electrodes opposing a third main electrode. An automatically operating change-over switch occasionally switches the lamp current to either the first or second electrodes. A reservoir of liquid sodium near the first electrode affects sodium vapor pressure in the discharge tube by the switching action.

9 Claims, 5 Drawing Figures

DISCHARGE LAMP OPERATING CIRCUIT

The invention relates to a device having a lamp which is provided with a metal vapour discharge tube having at least three electrodes. A reservoir for the metal whose vapour — in the operating condition of the lamp — participates in the discharge is being located near the first of these electrodes, and this first electrode is connected to an automatically operating switch. The position of the switch depends on the magnitude of the lamp current, the lamp being operated substantially ballastless. The invention also relates to a lamp which is particularly suitable for such a device.

A known device of the above type is, for example, described in Dutch Patent Application No. 7,204,033.

An advantage of that known device is that a discharge lamp associated with that device can be operated substantially without separate stabilisation ballast.

In that known device the electric auxiliary current for readjusting the vapour pressure in the discharge tube is as a rule only small, for example only approximately 10% of the discharge current between the two main electrodes of the discharge tube. A disadvantage of it is that said readjustment of the vapour pressure occurs rather slowly. With these ballastless lamps this might result in that sometimes the lamp current cannot be controlled any more. A further disadvantage is that switching on and off of said auxiliary current — which in the operating condition of the lamp occurs time and again in the indicated known device — causes sudden changes in the lamp load which sometimes leads to unpleasant brightness variations of that light source.

It is an object of the invention to provide a device of the type indicated in the preamble in which readjustment of the vapour pressure in the discharge tube occurs quickly and which is not accompanied by sudden changes in the lamp load.

A device according to the invention having a lamp is provided with a metal vapour discharge tube having at least three electrodes. A reservoir for the metal of which the vapour — in the operating condition of the lamp — participates in the discharge being located near the first of these electrodes, and this first electrode is connected to an automatically operating switch. The position of the switch depends on the magnitude of the lamp current, the discharge tube being operated substantially ballastless, is characterized in that the switch is a change-over switch and that in a first position of the switch the first electrode is switched off and the second electrode of the discharge tube is switched on and that in a second position of the switch the first electrode is switched on and the second electrode is switched off at least during given time intervals, the second position of the switch being available at the relatively low lamp current strengths, while the second electrode on the one hand and the reservoir together with the first electrode on the other hand are located in different nozzles of the discharge tube, while the reservoir is so positioned that — in the operating condition of the lamp — the coldest spot of the discharge tube is present in this reservoir.

An advantage of a device according to the invention is that readjustment of the vapour pressure in the discharge tube is done by means of the lamp current itself and not by means of a weak auxiliary current. Therefore said readjustment can be realized quickly.

The following information is given by way of explanation. Due to the presence of the change-over switch the lamp current can either flow through the nozzle of the discharge tube which comprises the reservoir or through the other nozzle of the discharge tube. In the first case the reservoir, — in which the coldest spot of the discharge tube is located — is more intensely heated by the lamp current so that the vapour pressure in the discharge tube has a tendency to increase. In the second case the reservoir is further removed from the discharge path so that the reservoir temperature is low so that more metal vapour condenses there which causes the vapour pressure in the discharge tube to decrease.

If the vapour pressure in the discharge tube threatens to become too low which results in too low a lamp current intensity due to an insufficient number of ions in the discharge tube, the automatic change-over switch becomes operative so that the lamp current is again passed through the nozzle which contains the reservoir. Consequently the reservoir is again heated more intensely so that the vapour pressure in the discharge tube and also the lamp current increases. At a relatively large value of the lamp current the change-over switch becomes active again so that the discharge path is then again removed to some distance from the reservoir so that the reservoir cools, some vapour condenses etc.

The relevant discharge lamp is thus stabilized by a vapour pressure in the discharge tube which is kept under control by means of the lamp current itself. In this respect the occasional change-over to another discharge path trajectory is of fundamental importance.

The reservoir might, for example, be located behind the first electrode.

In a preferred embodiment of a device according to the invention the reservoir is located along the path of the first to the second electrode.

An advantage of this preferred embodiment is that heating of this reservoir by the discharge, when the first electrode is switched on, may be very intense. The result is that the speed with which the vapour pressure in the discharge tube may be increased is very high.

In a further preferred embodiment of a device according to the invention in which a lamp is supplied with direct current the first and the second electrode are connected through the change-over switch to an input terminal of the device, which input terminal is destined for connection to the positive terminal of a supply source, a third electrode of the discharge tube being connected to a second input terminal which is destined for connection to the negative terminal of the supply source.

An advantage of this preferred embodiment is that in the switched-on position of the first electrode the potential of this electrode is at all times positive with respect to the third electrode so that, furthermore, a metal ion transport takes place over the entire trajectory from the first to the third electrode in that vapour pressure increasing situation. These ions are again neutralized and contribute to a further increase in the vapour pressure. It is true that when the second electrode is switched on a similar ion transport also takes place from the second to the third electrode, but said last ion transport causes no trouble in the nozzle which contains the reservoir.

In a further preferred embodiment of a device according to the invention which is destined for connection to an A.C. voltage source a first rectifier is included in the electrical connection from the switch to the first electrode, the pass direction of that rectifier being directed to the first electrode.

An advantage of this preferred embodiment is that while the ion current from the first to the third electrode is maintained in the switched-on condition of the first electrode, the ion current between the second and the third electrode — when the second electrode is switched on — reverses each half cycle of the mains supply. Thus said last ion current does not substantially affect the metal migration in the discharge tube.

Said last preferred embodiment can still be improved by connecting a second rectifier between on the one hand a point on the connection from the switch to the second electrode and on the other hand a point on the connection from that switch to an imput terminal of the device to which that switch is connected, in such a way that in the second position of the switch the two rectifiers are in antiparallel.

An advantage of this improvement is that the lamp load — in both positions of the change-over switch — is the same in the even and odd half cycles of the mains supply. In the first position of the change-over switch the current flows — depending on the half cycle of the mains supply — from the first electrode to the third electrode or from the third electrode through the second electrode to the second rectifier.

In a further preferred embodiment of a device according to the invention the discharge tube has two nozzles or legs at both ends, each of those nozzles containing an electrode, while a third rectifier is included in the electrical lead of the third electrode, namely in a similar manner as the first rectifier in the electrical lead of the first electrode while in the lead of the fourth electrode — which is located in the fourth nozzle of the discharge tube — a fourth rectifier is present, namely in a similar manner as the second rectifier in the lead of the second electrode while in the lead of the third and the fourth electrode there is a second change-over switch which is coupled with, and included in, the circuit in a similar manner as the first switch in the lead of the first and second electrode.

An advantage of this preferred embodiment is inter alia the symmetrical construction of the lamp so that it becomes less sensitive to the position, for example with respect to the horizontal, in which it is operated.

In a next preferred embodiment a resistor of approximately one ohm is included in the connection from an electrode of the lamp to an input terminal of the device, this resistor being shunted by an auxiliary device which is used for influencing the position of the switch(es).

An advantage of this preferred embodiment is that by means of that resistor it can be determined in a simple manner whether the lamp current must be switched to another main electrode of the discharge tube.

A change-over switch in a device according to the invention may be a mechanical change-over switch having one or more movable switching contacts.

In a preferred embodiment the change-over switch is constructed as a combination of two controlled semiconductor rectifiers, for example two thyristors. Control circuits of those controlled semiconductor rectifiers then render — depending on the magnitude of the lamp current — the one or the other controlled semiconductor rectifier conductive.

An advantage of this preferred embodiment is that the change-over switch has no movable parts so that the reliability of the device can be particularly large.

The lamp may, for example, be a mercury vapour discharge lamp.

In a preferred embodiment of a device according to the invention the lamp is a low-pressure sodium vapour discharge lamp.

An advantage of this preferred embodiment is that a very good control can be exercized on this lamp, more specifically due to the fact that a low-pressure sodium vapour discharge lamp often has already a positive voltage versus-current characteristic at a constant temperature of the discharge tube without a control of the vapour pressure. Therefore the risk of excessively large or excessively small lamp currents respectively is exceedingly small.

The invention will be further explained with reference to a drawing, in which.

Figure 1:
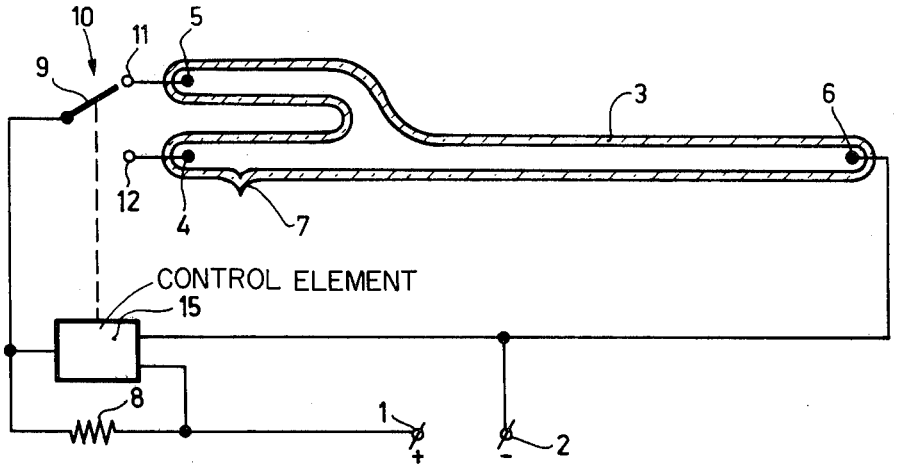
FIG. 1 is a circuit diagram of a first embodiment according to the invention destined for direct current supply.

In FIG. 1 references 1 and 2 are input terminals which are connected to a D.C. voltage source, more specifically with the polarity indicated in this Figure. Reference 3 represents a low-pressure sodium vapour discharge lamp. The lamp 3 is shown diagrammatically only. In the discharge space of the lamp 3 there are three electrodes 4, 5 and 6. The electrode 4 is the first electrode. Electrode 5 is the second electrode and reference 6 represents the third electrode. Near the electrode 4 there is a reservoir 7 for liquid sodium. The electrodes 4 and 5 are located in different nozzles or legs of the discharge tube.

The terminal 1 is connected to a switching arm 9, of a change-over switch 10 through a resistor 8 of approximately one ohm. A further contact 11 of the change-over switch 10 is connected to the electrode 5. A next contact 12 of the change-over switch 10 is connected to the electrode 4. The electrode 6 is connected to the negative terminal 2.

The resistor 8 is shunted by an auxiliary device, namely a control element 15. This element is also connected to terminal 2 for its supply. The control element comprises a so-called level-detector for determining the level of the current strength through the resistor 8 and furthermore a relay coil which operates the switching arm 9 of the change-over switch 10. At a relatively small current through the resistor 9 the movable end of the switching arm 9 is supported by the current 12. At a relatively large current through the resistor 8 the movable end of the switching arm 9 is supported by the contact 11.

The device described operates as follows. First the lamp 3 is ignited —by means of an auxiliary device not shown—. That auxiliary device consists, for example, of an electrical conductor whose one end is connected to the terminal 2 (potential of the electrode 6) whilst the other end is kept near the connecting point of the two nozzles of the electrodes 5 and 4 where it starts functioning as a kind of external auxiliary electrode. Due to the strong field which is consequently produced in the nozzle of the electrode 4 — for a switching arm 9 which is supported by contact 12 — the lamp 3 ignites. Hereafter a discharge of the electrode 4 to the electrode 6 will be first produced. Said auxiliary device for the ignition is removed. The discharge of the electrode 4 to the electrode 6 will heat the lamp 3 until sufficient sodium has evaporated from the reservoir 7. Should the lamp current which also flows through the register 8 become too high then the switching arm 9 of the change-over switch 10 is moved through the element 15 so that the movable end of the arm 9 is supported by the contact 11. Now the current flows from the second electrode 5 to the electrode 6. Then the reservoir 7 cools and sodium vapour condenses there so that the sodium vapour pressure in the discharge tube decreases. This results in a reduction of the lamp current. Through resistor 88 this is again measured by the element 15 which returns the switching arm again to its original position etc.

The change-over switch 10 is constructed in such a way that during the change-over action the one contact (for example 9, 11) is not interrupted before the other contact (9,12) has been made. This has the advantage that during the switch-over action the current in the lamp 3 is not interrupted.

Figure 2:
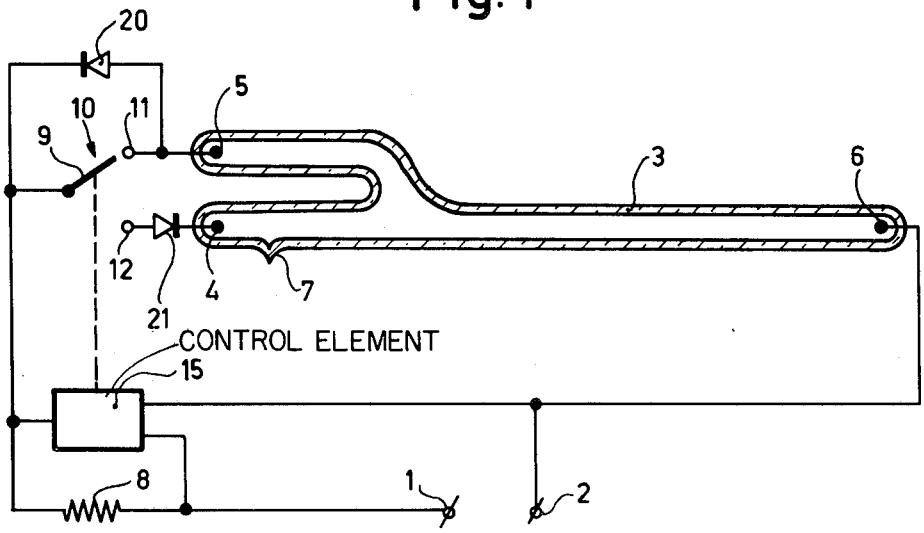
FIG. 2 is a circuit diagram of a second device according to the invention destined for alternating current supply.

The circuit of FIG. 2 is very similar to that of FIG. 1. However, the power supply now is an A.C. voltage supply. Besides that a rectifier 20 is added which is located between the contact 11 on the one hand and a junction point between the switching arm 9 and the resistor 8 on the other hand. An oppositely directed rectifier 21 is included in the connection from the contact 12 to the lamp electrode 4.

After the lamp 3 in the circuit of FIG. 2 has been brought to the operating condition, which can be done in a similar manner as indicated in the description of the device of FIG. 1, the control element 15 will also in the case of FIG. 2 alternatingly connect the switching arm 9 to contact 11 and to contact 12. When arm 9 is placed on contact 11 an alternating current flows between the electrodes 5 and 6. In the other position of the arm 9 a current from electrode 4 to the electrode 6 is followed in the next half cycle of the power supply mains by a current from the electrode 6 to the electrode 5, which latter current then flows through the rectifier 20, and resistor 8, to terminal 1.

Figure 3:
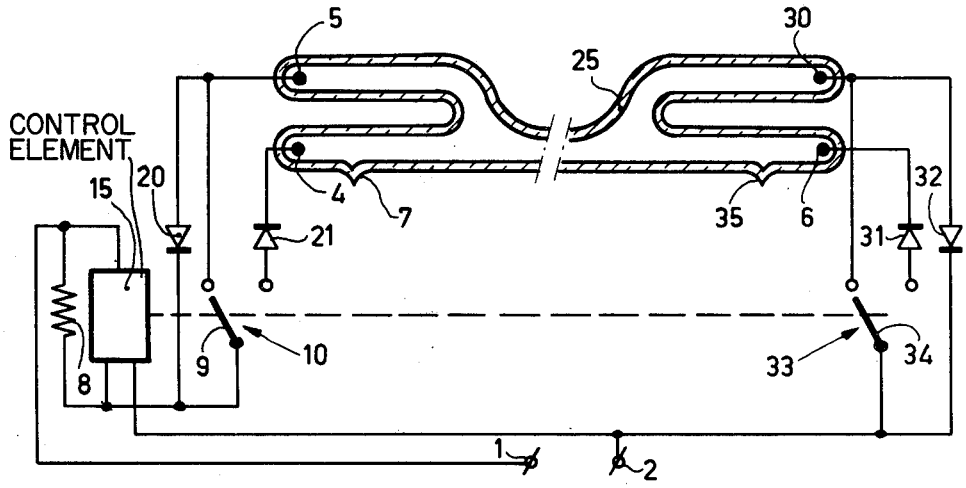
FIG. 3 is a circuit diagram of a third device according to the invention also destined for alternating current supply.

FIG. 3 shows a lamp 25 which is provided with four electrodes. This means that besides the electrodes mentioned in the previous circuit another electrode 30 is included in a fourth nozzle. The circuit diode 31, diode 32 and switching arm 34 of the electrodes 6 and 30 is equal to the circuit 21, 20, 9 of the electrodes 4 and 5. Near the electrode 6 there is a second sodium reservoir 35. The switching arms 9 and 34 of the two change-over switches are mechanically coupled and are operated together by the element 15. The operation of this device is substantially equal to that which is described at FIG. 2, however during the change-over action also the switching arm 34 is now operated. This results in currents through the electrode 6 and/or in currents through the electrode 30. The change-over switch 10 of the circuit of FIG. 2, and the change-over switches 10 and 33 of the circuit of FIG. 3 are of the same type as specified in the description of FIG. 1.

Figure 4:
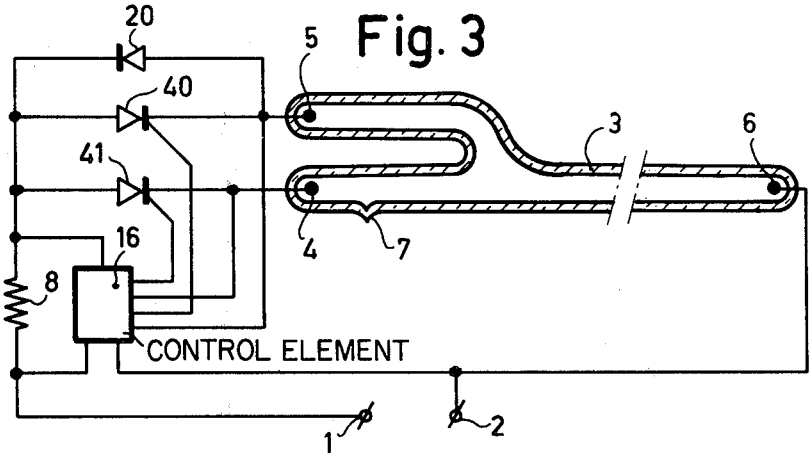
FIG. 4 is a variant of the device according to FIG. 2 in which the change-over switch is provided with controlled semi-conductor switches.

FIG. 4 is a variant of the circuit of FIG. 2. The change-over switch 10 and the rectifier 21 have now been replaced by two thyristors 40 and 41. A control element 16 sees to it that now the control circuit of the thyristor 40 (when the lamp current is too large) and of the control circuit of the thyristor 41 (when the lamp current is too small) is alternately switched on. To that end a control voltage is then applied between the control electrode and the cathode of the relevant thyristor. To this end the control element 16, which is not shown in detail, is constructed in a slightly different way than the control elements 15 in the previous figures.

Figure 5:
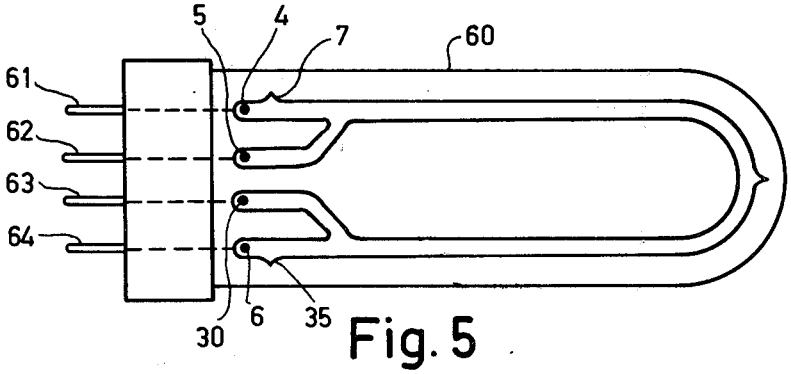
FIG. 5 is an elevational view of the discharge lamp for the circuit of FIG. 3.

FIG. 5 shows a more detailed drawing of the lamp 25 of FIG. 3. The discharge tube is U-shaped. Reference 60 indicates an outer bulb which envelopes the discharge tube. References 61 to 64 represent terminal pins of this lamp which are connected to the electrodes 4, 5, 30 and 6 respectively. (see also FIG. 3). Besides sodium also rare gas having a pressure of approximately 5.5 Torr and consisting of 99% neon and 1% argon is present in the discharge tube of the lamp. The length of a leg of the discharge tube is approximately 40 cm. Consequently the length of the discharge path from the electrode 4 to the electrode 6 is approximately $2 \times 40 = 80$ cm. The coldest spot of the discharge tube is in the reservoirs (7, 35).

In an embodiment of the combination of the circuit of FIG. 3 with the lamp of FIG. 5, the mains supply is a square-wave A.C. voltage of approximately 100 volts, 50 Herz. The lamp current varies between approximately 0.95 ampere and 1.05 ampere. The switch-over to another main electrode occurs in this example a few times per minute.

What is claimed is:

1. A device having a lamp which is provided with a metal vapor discharge tube having an elongated discharge tube having first end and a second bifurcated end having first and second legs; first, second, and third electrodes; said first electrode being disposed in said first leg, said second electrode being disposed in said second leg and said third leg being disposed in said first end; a reservoir of metal of the type which has a vapor which in the operating condition of the lamp participates in the discharge; a switch; means automatically operating said switch responsive to the magnitude of the lamp current; said discharge tube being operated substantially ballastless, said switch being connected to a source of electrical power and having a first position in which the first electrode is switched off and the second electrode of the discharge tube is switched on and a second position in which the first electrode is switched on and the second electrode is switched off, means positioning said switch in said second position of said switch at relatively low lamp current values, said reservoir being so disposed that the coldest spot of the discharge tube is present in said reservoir in the operating condition of the lamp.

2. A device as claimed in claim 1, wherein said reservoir is intermediate said first and second electrodes.

3. A device as claimed in claim 2 wherein said lamp cooperates with an associated D.C. power supply, said first and the second electrodes being alternately connected through the change-over switch to the positive terminal of the associated power supply and said third electrode cooperates with a negative terminal of the supply source.

4. A device as claimed in claim 2, wherein said lamp cooperates with an associated A.C. power supply and includes a first rectifier in an electrical connection from said switch to said first electrode.

5. A device as claimed in claim 4, further including a second rectifier connected to said second electrode.

6. A device as claimed in claim 4 wherein the discharge tube includes a bifurcation which is a fourth leg, said fourth leg including an electrode and further including a third rectifier in the electrical connection to said third electrode, and a fourth rectifier in the connection to said fourth electrode.

7. A device as claimed in claim 6, wherein said means positioning said switch includes a resistor of approximately one ohm and an auxiliary device connected in shunt to said resistor.

8. A device as claimed in claim 1, which cooperates with associated A.C. power supply and said switch comprises two semi-conductor rectifiers.

9. A device as claimed in claim 1, wherein said lamp is a low-pressure sodium vapor discharge lamp.

* * * * *

UNITED STATES PATENT AND TRADEMARK OFFICE

CERTIFICATE OF CORRECTION

PATENT NO. : 4074172

DATED : February 14, 1978

INVENTOR(S) : GUSTAAF ADOLF WESSELINK ET AL

It is certified that error appears in the above-identified patent and that said Letters Patent are hereby corrected as shown below:

Col. 6, line 32, after "tube having" insert --a-- line 36, after "third" change "leg" to --electrode--

Signed and Sealed this

*Fourth* Day of *December 1979*

[SEAL]

*Attest:*

SIDNEY A. DIAMOND

*Attesting Officer*

*Commissioner of Patents and Trademarks*